United States Patent [19]

Boggero

[11] Patent Number: 4,709,637

[45] Date of Patent: Dec. 1, 1987

[54] TEMPERATURE SENSITIVE PYROTECHNICAL TRAIN INTERRUPTION DEVICE

[75] Inventor: Henri Boggero, Velizy, France

[73] Assignee: Matra, Paris, France

[21] Appl. No.: 737,167

[22] Filed: May 23, 1985

[30] Foreign Application Priority Data

May 25, 1984 [FR] France ..... 84 08262

[51] Int. Cl.[4] ..... F42C 15/06; F42C 15/20; F42C 15/28

[52] U.S. Cl. ..... 102/481; 102/378; 60/254

[58] Field of Search ..... 102/222, 273, 378, 473, 102/481; 89/1.14; 60/254

[56] References Cited

U.S. PATENT DOCUMENTS

| | | | |
|---|---|---|---|
| 2,084,218 | 6/1937 | Remondy | 102/222 |
| 2,314,891 | 3/1943 | Moore | 102/222 |
| 2,453,151 | 11/1948 | Miller, Jr. | 102/222 |
| 3,167,910 | 2/1965 | Weaver | 60/254 X |
| 3,173,364 | 3/1965 | Nordzell | 102/481 |
| 3,352,242 | 11/1967 | McFann et al. | 102/222 |
| 3,487,644 | 1/1970 | Kyle | 60/254 |
| 3,613,374 | 10/1971 | Ritchey | 60/254 X |
| 3,665,857 | 5/1972 | Radnich et al. | 102/481 |
| 4,348,957 | 9/1982 | White et al. | 102/378 |
| 4,458,482 | 7/1984 | Vetter et al. | 102/481 |
| 4,478,151 | 10/1984 | Vetter et al. | 102/481 |

*Primary Examiner*—Deborah L. Kyle
*Assistant Examiner*—Ted L. Parr
*Attorney, Agent, or Firm*—Larson and Taylor

[57] ABSTRACT

A unitary device for venting a rocket motor of an ordnance item having a warhead comprises a circumferential belt containing a cutting explosive charge and constructed for removable mounting around a housing of the rocket motor, and an activating device having a casing permanently connected to the belt. The activating device further includes, in the casing, a striker for movement therein, a spring located and operatively associated with the striker for urging the striker toward the primer from a rest position, and a latch for retaining the striker in said rest position, said latch including a part of eutectic alloy normally opposing movement of the striker and becoming ineffective above a predetermined melting temperature.

7 Claims, 3 Drawing Figures

FIG.1.
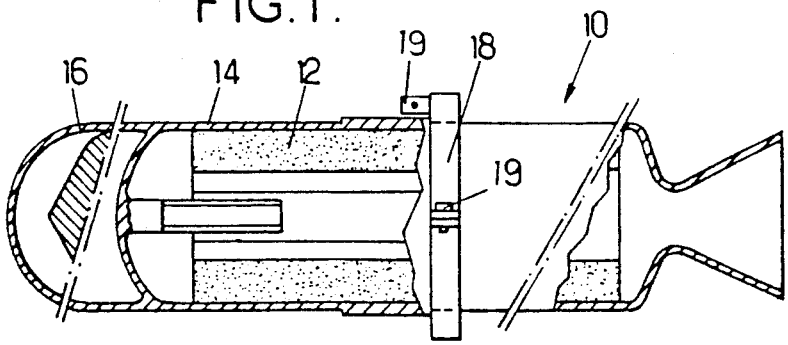
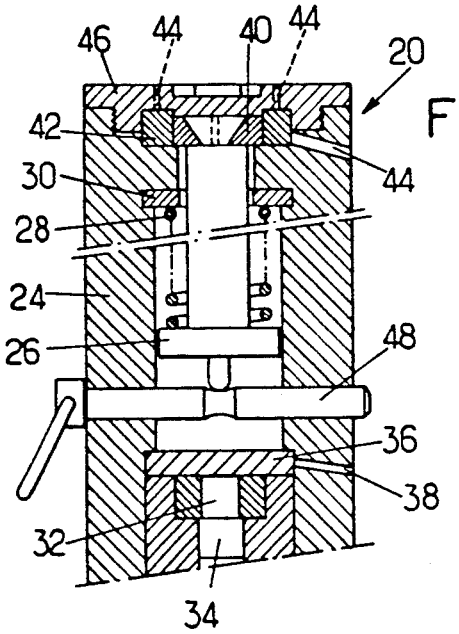
FIG.2.
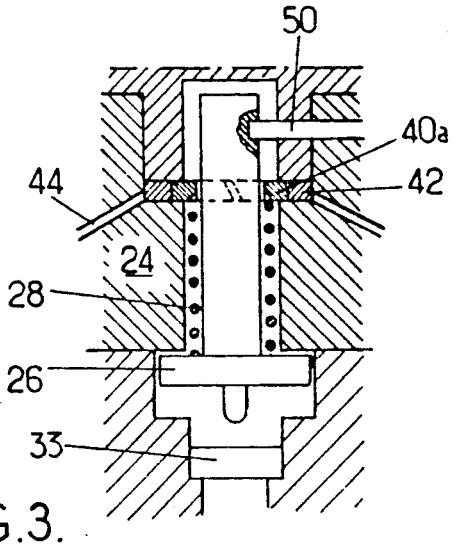
FIG.3.

TEMPERATURE SENSITIVE PYROTECHNICAL TRAIN INTERRUPTION DEVICE

BACKGROUND AND SUMMARY OF THE INVENTION

The invention relates to interruption devices located on explosion trains for safety purposes. Safety devices are found in numerous equipments comprising a warhead and their role is to increase safety during storage, handling and transport.

Such safety devices in general comprise a part movable between a position in which it restrains an activation process and a position in which it allows or causes it. Most safety devices have the drawback of comprising a movable part and a mechanism for moving it. Safety devices including a fusible material have also been suggested. For instance, U.S. Pat. No. 2,453,151 (Miller) discloses a safety device for a rotatable projectile, comprising a barrier of an alloy which is fused by heat on discharge of the projectile from a gun for permitting operation of the striker. However, that device relies on centrifugal force for arming the train. Similarly, British No. 453,685 (Remondy) discloses a fuze whose striker is retained by a fusible joint until the latter has been heated by combustion of a slow burning composition. There is also known an ejectable fuze carried by a warhead with a connection by a joint which fails at a predetermined level of temperature for lessening the chances of the warhead exploding in a fire situation (U.S. Pat. No. 4,022,130 to Johnson et al.). Reliance is had on the pressure from deterioration of the booster material for ejection.

It is an object of the invention to provide an explosion train interruption device comprising no moving part and not requiring assistance by centrifugal force. It is a more specific object to provide such a device for activating (or de-activating) an explosion train should there be a rise in the surrounding temperature beyond a predetermined value, relying on an eutectic alloy part melting at said temperature and placed in the train. It is still a more specific object to provide an activation device for use in a system for venting a propulsion charge of an ordnance item carrying a warhead upon temperature increase beyond a predetermined value.

According to an aspect of the invention, there is provided an activation device comprising a casing, primer means of a venting system in said casing, a striker slidably received in said casing for movement toward said primer means, spring means for urging said striker toward said primer means, and retaining means cooperating with said striker for positively retaining said striker at a distance from said primer means and including an eutectic material selected to melt at a predetermined temperature lower than a temperature of ignition.

For ensuring the storage safety of an ordnance item having a propellent charge and a warhead, the eutectic alloy retaining means may form or hold a restraining bolt of a striker against the action of a spring tending to project this striker onto an activation primer of a deconfinement system for the propellent charge; thus, should a fire occur in the storage premises, the risk of seeing the propellent charge project the military charge up to great distances is overcome. The eutectic forming the part will then be chosen from a material which loses its cohesion above the maximum anticipated storage temperature, which is usually 70° C. A second eutectic part may be interposed between the striker and the primer, or in the explosion train properly speaking. In this case, it will be made from a material having a melting point less than that of the first part.

In another embodiment, an eutectic alloy part is placed between two elements in the explosion train so as to stop propagation of the detonation wave until the eutectic has been brought into liquid condition, by heating possibly caused by means of an electric resistance buried in the part or surrounding it. The thickness of the part will be very different depending on the energy to be absorbed: the thickness may be reduced when the part is placed between a primer and relay; it will in general need to be of a thickness substantially greater when the part is between a relay and detonator.

The invention will be better understood from the following description of particular embodiments given by way of examples.

SHORT DESCRIPTION OF THE DRAWINGS

FIG. 1 is a simplified diagram, in longitudinal section, of a fraction of the propellent charge of a piece of ammunition equipped with a deconfinement explosive system having an interruption device in accordance with the invention;

FIG. 2 is a simplified view, in section, of a device usable in the system of FIG. 1; and FIG. 3, similar to FIG. 2, shows another embodiment.

DESCRIPTION OF A PREFERRED EMBODIMENT

The piece of ammunition 10, a fraction of which is shown in FIG. 1, comprises a propellent charge 12 contained in a case 14 and a warhead 16 placed at the front. Should a fire occur, the means for igniting the propellent charge 12 may be heated to a temperature causing actuation of the charge, which may result in the projection of the whole of the ammunition to a great distance. The embodiment of the invention shown in FIG. 1 is intended to get over this risk by deconfining the propellent charge, preventing combustion thereof under conditions such that there may be projection should the temperature rise above the value considered as maximum during storage, less than the dangerous level. The deconfinement system shown in FIG. 1 is formed by a system 18 containing an explosive cord, having means for fixing it in a suitable position along the propellent charge and for readily removing it before fitting it on a firing vehicle. This system may be formed from several parts and have clamping means 19. It comprises an interruption device for activating, then triggering off, the explosion train for firing the cord contained in the system. This interruption device 20 (FIG. 2) comprises a body 24 containing a striker 26 subjected to the action of a spring 28 resting on a washer 30 fast with the body. The spring tends to project the striker onto a primer or firing pin 32 in contact with the detonator 34 or a pyrotechnic relay.

A first part is formed by a disk 36 placed in the path of the striker so as to prevent it from striking the primer 32. This part 36 is made from a eutectic alloy, thefore having a well defined melting point. So as to rapidly obtain a thermal balance between part 36 and the ambient atmosphere, the case is pierced with holes 38 evenly spaced apart angularly, through which the hot gases in which the ammunition may possibly be bathed may come into contact with the eutectic and cause melting thereof. These holes 38 also allow the eutectic, when it has exceeded its melting point, to flow outwardly, thus freeing the path of the striker.

The striker is in addition restrained, as long as the temperature does not exceed a given threshold, by an annular bolt 40, made from several sections, held engaged in a groove of the striker by a second ring-shaped eutectic alloy part 42. Holes 44 pierced in the case at regular angular intervals allow part 42 to be exposed to the external actions and allow the eutectic to flow when it reaches its melting point, thus freeing the sections of bolt 40 which may move apart and so release the striker. The body is closed, in the embodiment shown, by a screwed cover 46 which may also be pierced with holes.

The body 24 of the device shown also comprises aligned holes for inserting a pin 48, which will be generally made from steel, for securing the striker. This pin will be positioned during storage of system 18 before fitting to a piece of ammunition 10. It will be removed once the system is in position, so as to allow the device to operate.

The material forming the first part 36 must have a melting point less than that of the material of the second part 42. The range of eutectic materials available allows this condition to be complied with without difficulty, for example if a range of from 70° C. to 130° C. is used, the following eutectic materials may be used: Sn 13%, Bi 49%, Pb 27.3%, Cd 10% and Sn 40%, Bi 36%, Zn 4%.

The operation of the device in the case of an external thermal aggression is as follows: when the gases surrounding device 20 reach the melting temperature of the eutectic materials, the first part 36 loses its cohesion and causes the barrier between the striker and the primer to disappear. If the temperature continues to increase, the second part 42 melts in its turn, releasing the sections of bolt 40 which may move apart so as to release the striker 26 subjected to the action of spring 28. The striker whose path has been freed by melting part 36, strikes the primer and activates the train. The system then deconfines the propellent charge by chopping up.

A device in accordance with the invention may also be used, as has already been seen, for inhibiting an activation train. In the embodiment shown in FIG. 3 (where the parts corresponding to those in FIG. 2 are designated by the same reference number), the striker is restrained by a detent 50 whose withdrawal causes activation. In order to prevent this activation and so inhibit the explosion train should the temperature rise beyond a given threshold, the bearing surface **40*a* for spring 28 is formed by a ring made from several sections retained by a eutectic ring 42. Melting of the eutectic material, if a maximum temperature is exceeded, releases sections of ring 40*a*. Spring 28 extends and is thus unable to project the striker onto primer 33**.

In yet another embodiment of the invention, not shown, an electric heating resistance is embedded in the eutectic part (or one of the parts) of the device or surrounds it. With this heating resistance, the part may be at will heated to its melting point and, depending on the case, the explosion train may be inhibited or, on the contrary, its operation may be initiated.

Melting of the part may therefore form either the equivalent of arming before activation, or on the contrary inhibition. The heating may be controlled by the staff or, on the contrary, be automatically provided. For example, in the case of a missile released from an aircraft and having an air driven generator, arming may take place following the supply of electric energy resulting from rotation of the air driven generator.

I claim:

1. A unitary system for venting a rocket motor of an ordnance item carrying a warhead, comprising:

a circumferential belt containing a cutting explosive charge and constructed for removable mounting around a housing of said rocket motor, and an activating device having:

a casing permanently connected to said belt, primer means in said casing for energization of said explosive charge, a striker mounted in said casing for movement therein, a spring means located in said casing and operatively associated wtih said striker for urging said striker toward said primer means from a rest position, and latch means for retaining said striker in said rest position, said latch means including a part of eutectic alloy normally opposing movement of said striker, so located as to be in thermal balance with the ambient atmosphere and becoming ineffective above a predetermined melting temperature.

2. A system according to claim 1, further comprising an intermediate firing pin communicating with said primer through a flash passage and a barrier in said flash passage, said barrier consisting of an eutectic alloy having a melting point lower than the melting point of said part.

3. A system according to claim 1, wherein said latch means further includes a plurality of segments radially movable in said casing between an inner position where they are interposed between an inclined surface of said striker and a radial surface of said casing and said part has an annular shape and encircles said segments for preventing them from moving radially outwardly apart, said part being located in a chamber defined by said casing and communicating with the outside via passages in said casing arranged for outflow of said eutectic alloy when melted.

4. A system for venting a propulsion charge of an ordnance item carrying a warhead, the system being responsive to a temperature increase of an environment beyond a predetermined value, comprising:

an explosive charge for venting the propulsion charge when actuated and rendering subsequent ignition of the propulsion charge ineffective to propel the warhead; and an actuator device for said explosive charge including (a) a casing, (b) primer means located in said casing and operatively associated with said explosive charge for initiation thereof, (c) a striker slidably received in said casing for movement toward said primer means, (d) spring means for urging said striker toward said primer means, (e) retaining means co-operating with said striker for positively retaining said striker at a distance from said primer means, said retaining means including a structural element of eutectic material opposing movement of said striker when in solid condition, so located as to be subjected to said environment and selected to melt at a predetermined temperature lower than a temperature of ignition of the propulsion charge and, (f) a barrier of an additional eutectic material having a melting point lower than the melting point of the eutectic material of said retaining means, said barrier being interposed in the path of said striker between a rest position of said striker and said primer means.

5. A system for venting a propulsion charge of an ordnance item carrying a warhead, the system being responsive to a temperature increase of an environment beyond a predetermined value comprising:

an explosive charge for venting the propulsion charge when actuated such that an inadvertent subsequent ignition of the propulsion charge is ineffective to propel the warhead; and an actuation device for said explosive charge including (a) a casing, (b) primer means located in said casing and operatively associated with said explosive charge for initiation thereof, (c) a striker slidably received in said casing for movement toward said primer means, (d) spring means for urging said striker toward said primer means, and (e) retaining means co-operating with said striker for positively retaining said striker at a distance from said primer means, said retaining means including a structural element of eutectic material opposing movement of said striker when in solid condition, so located as to be subjected to said environment and selected to melt at a predetermined temperature lower than a temperature of ignition of the propulsion charge.

6. A system according to claim 5, wherein said retaining means constitutes a latch locked in said casing and retaining said striker.

7. A system according to claim 5, further comprising latch means retained by said retaining means in a position where it engages said striker for retaining it against the biasing force of said spring.

* * * * *